US011209848B2

(12) United States Patent
Avci et al.

(10) Patent No.: US 11,209,848 B2
(45) Date of Patent: Dec. 28, 2021

(54) FAST REGULATOR ARCHITECTURE HAVING TRANSISTOR HELPER

(71) Applicant: Analog Devices International Unlimited Company, Limerick (IE)

(72) Inventors: Celal Avci, Istanbul (TR); Tarik Cavus, Istanbul (TR); Savas Tokmak, Istanbul (TR); Yalcin Alper Eken, Istanbul (TR)

(73) Assignee: Analog Devices International Unlimited Company, Limerick (IE)

( * ) Notice: Subject to any disclaimer, the term of this patent is extended or adjusted under 35 U.S.C. 154(b) by 901 days.

(21) Appl. No.: 15/175,376

(22) Filed: Jun. 7, 2016

(65) Prior Publication Data

US 2017/0351284 A1 Dec. 7, 2017

(51) Int. Cl.
*G05F 1/575* (2006.01)
*G05F 1/565* (2006.01)

(52) U.S. Cl.
CPC ..... *G05F 1/575* (2013.01); *G05F 1/565* (2013.01)

(58) Field of Classification Search
CPC . G05F 1/575; G05F 1/56; G05F 1/573; G05F 3/262; G05F 1/565; H02M 3/158; H02M 3/156; H02M 1/32; H02M 2001/0009; H02M 2001/0025; H02M 1/36; H02M 2003/1566; H02M 3/1584; H02M 3/1588
See application file for complete search history.

(56) References Cited

U.S. PATENT DOCUMENTS

| | | | | |
|---|---|---|---|---|
| 7,218,087 | B2 | 5/2007 | Lin | |
| 9,024,602 | B2 * | 5/2015 | Fort | G05F 1/46 323/280 |
| 9,046,909 | B2 | 6/2015 | Leibowitz et al. | |
| 9,081,404 | B2 | 7/2015 | Jackum et al. | |
| 9,778,303 | B2 * | 10/2017 | Tumati | G05F 1/56 |
| 2003/0098674 | A1 * | 5/2003 | Ostrom | G05F 1/56 323/276 |
| 2007/0075692 | A1 | 4/2007 | Ostrom et al. | |
| 2011/0084767 | A1 * | 4/2011 | Kocer | H03F 1/3205 330/296 |
| 2012/0038332 | A1 * | 2/2012 | Lin | G05F 1/575 323/277 |
| 2013/0271095 | A1 | 10/2013 | Missoni et al. | |
| 2014/0232366 | A1 | 8/2014 | Lawson et al. | |

(Continued)

FOREIGN PATENT DOCUMENTS

JP 2014115690 * 6/2014 ..... G05F 1/56

*Primary Examiner* — Matthew V Nguyen
(74) *Attorney, Agent, or Firm* — Schwegman Lundberg & Woessner, P.A.

(57) ABSTRACT

Apparatus and methods for assisting a voltage regulator. In an example, a voltage regulator can include an error amplifier configured to compare a reference voltage with a representation of an output voltage of the voltage regulator, an output transistor coupled to a supply voltage and configured to receive an output of the error amplifier and to provide the output voltage, and an auxiliary-current circuit including a helper transistor having a terminal coupled to the output voltage, the helper transistor configured to turn on when the output voltage drops due to current demand from the load and to provide charge current to the load in addition to current provided by the output transistor.

17 Claims, 3 Drawing Sheets

(56) References Cited

U.S. PATENT DOCUMENTS

| | | | | |
|---|---|---|---|---|
| 2014/0253076 | A1* | 9/2014 | Utsunomiya | H02M 3/158 323/282 |
| 2015/0061622 | A1* | 3/2015 | Bhattad | G05F 1/573 323/280 |
| 2015/0061772 | A1 | 3/2015 | Bhattad | |
| 2015/0309517 | A1 | 10/2015 | Leibowitz et al. | |

* cited by examiner

FAST REGULATOR ARCHITECTURE HAVING TRANSISTOR HELPER

BACKGROUND

DC-to-DC voltage conversion is useful in electronic devices, especially mobile devices that rely on a battery or similar fixed or rechargeable energy source for power. Voltage conversion can help generate steady output voltage levels from input voltage levels that can vary substantially as power is consumed from the energy source or as the energy source is being charged. Voltage regulator response to changing load conditions can be very demanding in certain applications.

SUMMARY

The present inventors have recognized, among other things that certain approaches to a voltage regulator attempt to provide fast, well-regulated output voltage in response to fast changes in load conditions but use a large load capacitor coupled to the output voltage. The load capacitor, even when used in conjunction with a Miller capacitor, may be sized to accommodate the anticipated change in current demand. Some regulator approaches attempt to reduce the load capacitor, but can incur instability during certain load disturbances. The load capacitor of certain approaches to voltage regulators can demand use of large board or chip space of an electronic device that could otherwise be used to provide more functionality.

Accordingly, this patent application describes, among other things, an apparatus and methods for assisting a voltage regulator. In an example, a voltage regulator can include an error amplifier that can be configured to compare a reference voltage with a representation of an output voltage of the voltage regulator. An output transistor can be coupled to a supply voltage and configured to receive an output of the error amplifier and to provide the output voltage. An auxiliary-current circuit, or helper circuit, can include a helper transistor that can have a terminal coupled to the output voltage. The helper transistor can be configured to turn on when the output voltage drops such as due to current demand from the load and to provide charge current to the load in addition to current provided by the output transistor. Further details are described below.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present inventor has recognized a need for helper methods and circuits that can allow a voltage regulator to supply fast peak current demands using a relatively small load capacitor or load capacitance. In an example, as explained herein, the main regulator loop need not be affected by the auxiliary-current circuit, or electrically isolated from the auxiliary-current circuit, and can maintain stability using a relatively small load capacitor.

Figure 1:
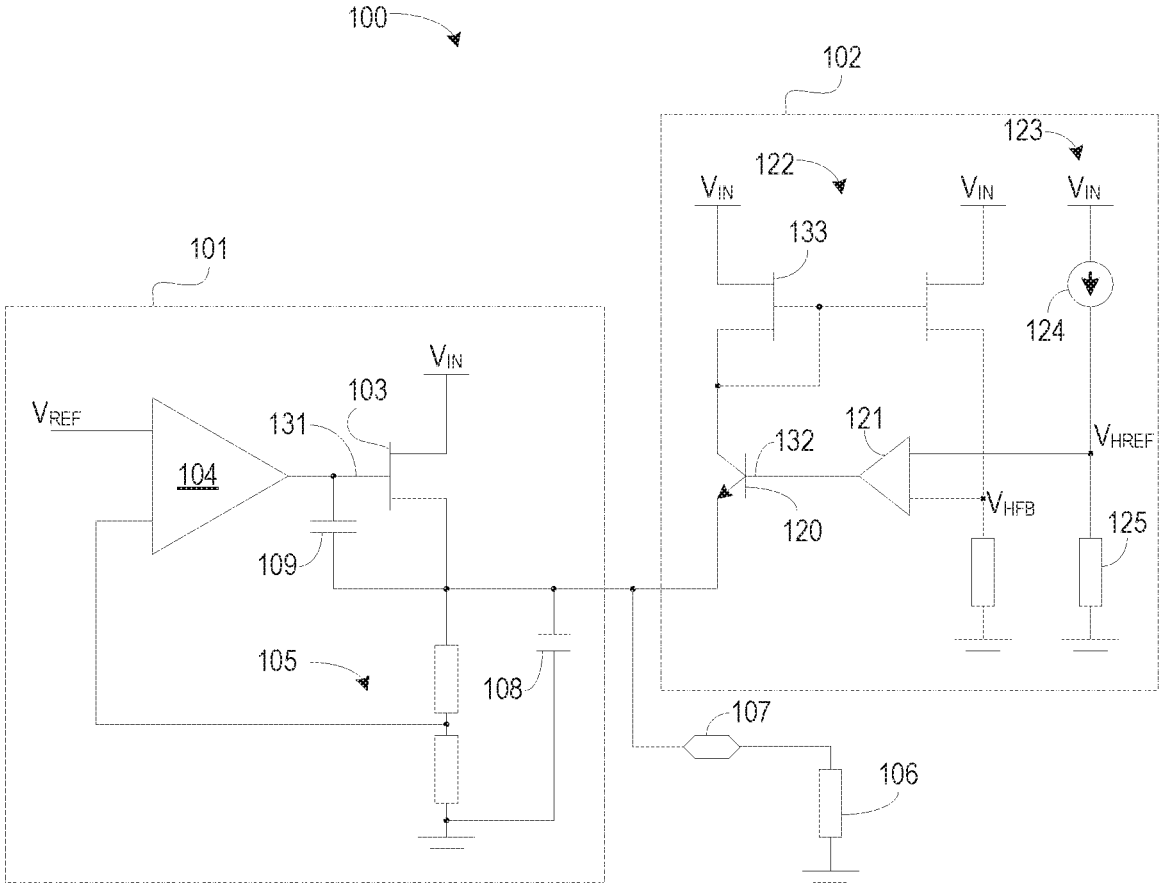
FIG. 1 illustrates generally a regulator circuit according to an example of the present subject matter.

FIG. 1 illustrates generally a regulator circuit 100 according to an example of the present subject matter. The regulator circuit 100 can include a voltage regulator 101 and an auxiliary-current circuit 102. The voltage regulator 101 can include an output transistor or a regulator transistor 103, an error amplifier 104, a feedback circuit 105, and an output capacitor 108. In certain examples, the voltage regulator 101 can optionally include a Miller capacitor 109 to improve stability of the voltage regulator 101 without adding a large output capacitor 108. The error amplifier 104 can drive the control node 131 of the regulator transistor 103 to transfer charge received at the regulator transistor 103 from the input voltage rail ($V_{IN}$) to an output node 107 of the voltage regulator 101. Resistance to charge flow at the output node by a load 106, for example, a resistive load, a capacitive load, an inductive load, or a combination thereof can be present, along with an output voltage ($V_{OUT}$) at the output node 107. The output capacitor 108 can store charge, such as to help reduce ripple in the output voltage ($V_{OUT}$). However, larger capacitors are more expensive in terms of chip space so providing the ability to reduce ripple for extended periods and for large fluctuations can be difficult.

The feedback circuit 105 can provide a voltage-divided or other representation of the output voltage at node 107 to one of the inputs of the error amplifier 104. A voltage reference ($V_{REF}$) can be received at the other input of the error amplifier 104. The error amplifier 104 can control the regulator transistor 103 according to a difference between the reference voltage ($V_{REF}$) and the representation of the output voltage ($V_{OUT}$). In certain applications, as the current draw of the load 106 increases, the output voltage ($V_{OUT}$) at node 107 of the linear transistor regulator 101 can drop. The output voltage drop can create an offset at the input to the error amplifier 104, in response to which the error amplifier 104 can turn on, or increase the charge passed by, the regulator transistor 103. The increased charge transfer can cause the output voltage ($V_{OUT}$) at node 107 to rise until an equilibrium is attained at the error amplifier 104. In situations where the load current transient change is large and fast, since the error amplifier bandwidth is limited (few MHz), the error amplifier may not respond to large and fast load current change. In such situations, the output capacitor 108 is left to supply large majority of the load current. As discussed above, employing a large output capacitor 108 can reduce the variation of the output voltage ($V_{OUT}$) in response to a large and fast load current transients, however, large capacitors can also demand large areas of an integrated circuit or a large off-chip component. In certain examples, the line differentiating between low-frequency, such as low frequency load conditions or limited bandwidth, and high-frequency, such as transients, can be any frequency between 1 Megahertz (MHz) and 10 MHz.

An auxiliary-current circuit 102 can help provide at least a portion of the charge reserve that can be used to alleviate or reduce the effects that a cycling load can have on the output voltage ($V_{OUT}$) of the regulator circuit 100 without also consuming a large area of the integrated circuit. The auxiliary-current circuit 102 can include a helper transistor 120, a feedback amplifier 121, a current mirror 122, and a reference voltage generator 123. The reference voltage generator 123 can include a current source 124 that can be coupled in series with a resistance or resistor 125, such as to provide a helper threshold voltage to the feedback amplifier 121. An Output of the auxiliary-current circuit 102 can be coupled to the output node 107 of the linear transistor regulator 101. In some examples, the output of the auxiliary-current circuit 102 can include a switched node of the helper transistor 120 such as the emitter of the illustrated NPN transistor, for example. In some examples, the helper transistor 120 can include a bipolar junction transistor (BJT), or a field effect transistor (FET). As a load current increases and the output voltage drops, the helper transistor 120 can turn on and provide auxiliary charge to the load 106. The auxiliary charge provided by the auxiliary-current circuit 102 can be in addition to the charge provided by the linear transistor regulator 101.

The feedback amplifier 121 can maintain the voltage at the control node 132 of the helper transistor 120 at a predetermined or specified level. The reference voltage provided by the feedback amplifier 121 can be set such that when the output voltage ($V_{OUT}$) of the linear transistor regulator 101 is at or above a desired level, the helper transistor 120 provides a very small current to the load 106. The reference voltage provided from the limiting amplifier 121 can be set through a low bandwidth feedback loop that can include the helper transistor 120, the current mirror 122 and the feedback amplifier 121. In certain examples, the feedback loop can set the reference voltage 132 at the output of feedback amplifier 121 such that the current on the helper transistor 120 is limited at DC or low frequency load conditions such that the main loop 101 is not affected. The low bandwidth feedback loop for the helper transistor 120 can maintain the control node 132 voltage substantially constant even during output node voltage disturbances or load transients. The limited current value of the helping transistor 120 at DC or low frequency load condition is the same as the current provided by the current source 124 if the current mirror 122 ratio is 1 and the impedance 125 is same as the feedback impedance. However for fast load transients or voltage disturbances at node 107, since the node 132 voltage is constant, any voltage drop on node 107 (due to disturbance or any load transient) will increase base emitter voltage of helping transistor 120 and by the help of low impedance diode connected transistor 133, helping transistor 120 can supply large amounts of transient current from Vin.

For example, as the output voltage at the output node 107 of the voltage regulator 101 falls, the helper transistor 120 can turn on or turn on more strongly and additional auxiliary current can be supplied to load 106 via the helper transistor 120. In certain examples, as the output voltage falls ($V_{OUT}$), the current supplied by the auxiliary-current circuit 102 can dominate or be greater than the current supplied to the load via the voltage regulator 101. As the output voltage ($V_{OUT}$) begins to rise, the current supplied from helper transistor 120 is reduces as the base to emitter voltage of the helper transistor also is reduced. As the output voltage ($V_{OUT}$) rises further to the desired output voltage level, the circuit 102 returns back to initial conditions at which the auxiliary-current circuit 102 supplies a very small current to the output node 107 and does not affect the main control loop of the voltage regulator 101. Thus, the regulator circuit 100 can help supply fast, peak current demands with a relatively small output capacitor 108.

In certain examples, the input voltage ($V_{IN}$) for the regulator 101 can be same as the input voltage ($V_{IN}$) for the auxiliary-current circuit. In some examples, the input voltage ($V_{IN}$) for the auxiliary-current circuit can be different than the input voltage (YIN) for the regulator 101. In some examples, the input voltage ($V_{IN}$) of the auxiliary-current circuit 102 can be higher than the input voltage ($V_{IN}$) of the regulator 101 to allow for more voltage headroom such that a dropping output voltage ($V_{OUT}$) can more quickly turn on the helper transistor 120.

Figure 2:
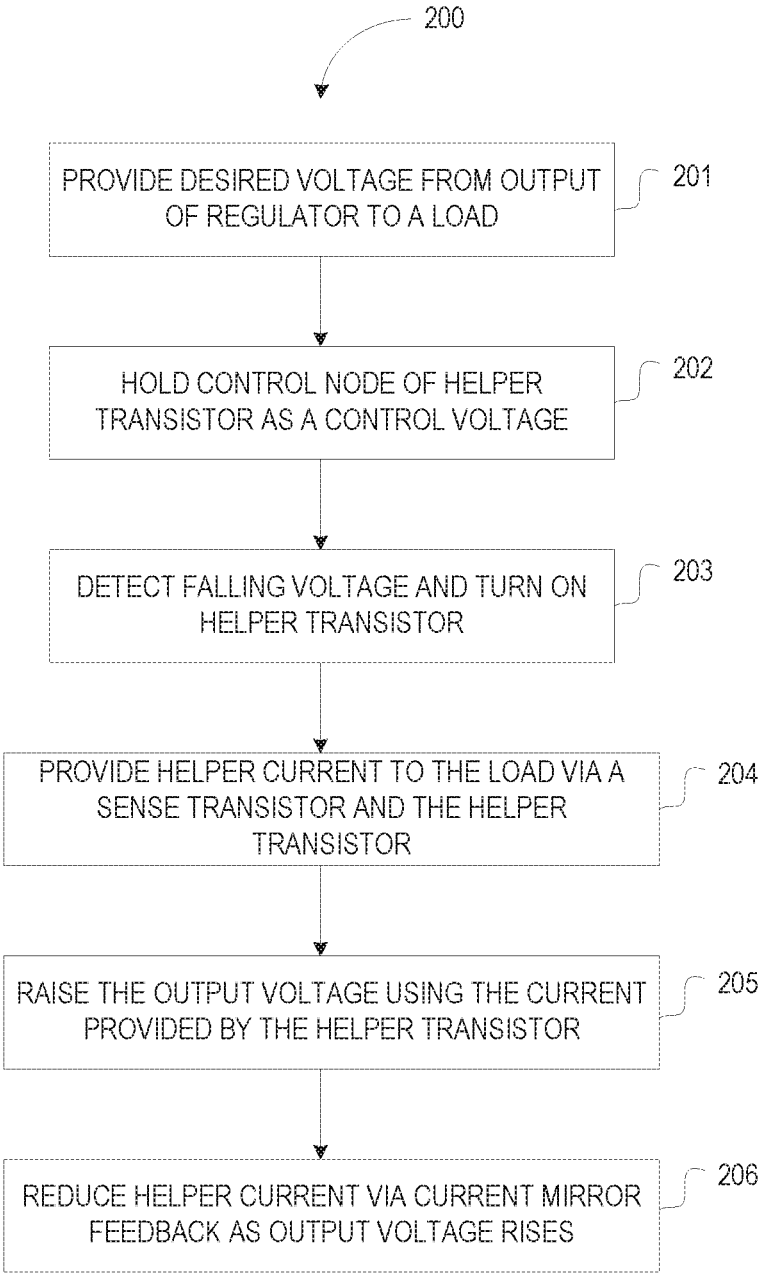
FIG. 2 illustrates generally a flowchart of method of operating a regulator with an auxiliary-current circuit according to an example of the present subject matter.

FIG. 2 illustrates an example of a technique (e.g., using by not limited to the example components of the embodiment of FIG. 1) of operating a regulator 101 with an auxiliary-current circuit 102 such as to help provide auxiliary peak current according to an example of the present subject matter. At 201, a desired voltage can be provided to a load at an output at node 107 of a voltage regulator 101. In many situations, the desired output voltage can be provided by the voltage regulator 101 without the assistance of the auxiliary-current circuit 102. In such situations, the regulator transistor 103 can be controlled by the output of the error amplifier 104 that represents the error generated between a reference voltage ($V_{REF}$) and the representation of the output voltage provided by the feedback circuit 105. At 202, the control node 132 of a helper transistor 120 of the auxiliary-current circuit 102 can be held at a first control voltage to provide little or no current to the load 106 from the auxiliary-current circuit 102 when the output voltage ($V_{OUT}$) is within a threshold of a desired output voltage. At 203, a falling voltage at the output node 107 of the voltage regulator 101 can be detected by an auxiliary-current circuit 102, for example, as the difference between the regulator output voltage and the helper control voltage increases, and, in response, turns on the helper transistor 120. In certain examples, the auxiliary-current circuit 102 can be a circuit separate from the voltage regulator 101 and can share a connection with the voltage regulator 101 at the output node 107. At 204, auxiliary helper current can be provided to the load 106 such as via a sense transistor 133 of a current mirror 122 and via the helper transistor 120. At 205, the helper current provided by the auxiliary-current circuit 102 can assist in raising the output voltage ($V_{OUT}$) at the output node 107 of the voltage regulator 101. At 206, feedback provided by the current mirror 122 can reduce the helper current as the output voltage ($V_{OUT}$) at the output node 107 approaches the desired output voltage. In certain examples, a helper amplifier 121 can compare a helper reference voltage ($V_{HREF}$) and a helper feedback voltage ($V_{HFB}$) provided by the current mirror such as to limit the current of the auxiliary-current circuit 102 when the output voltage ($V_{OUT}$) at the output node 107 is at or near the desired output voltage.

Figure 3:
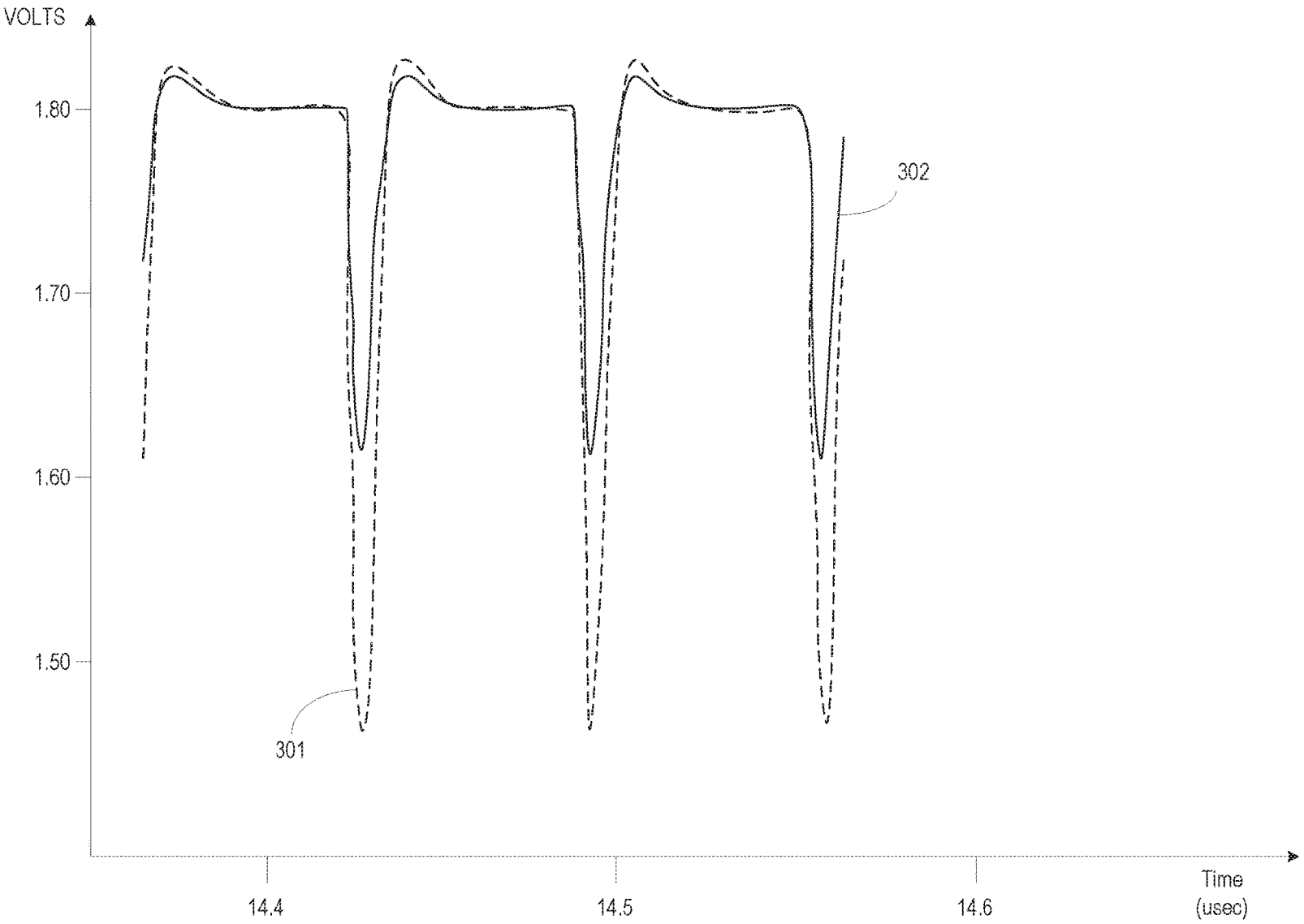
FIG. 3 illustrates graphically response improvements provided by a regulator that includes an auxiliary-current circuit compared to a regulator without an auxiliary-current circuit.

FIG. 3 illustrates graphically response improvements provided by a regulator that includes an auxiliary-current circuit compared to a regulator without an auxiliary-current circuit. The vertical axis shows output voltage and the horizontal axis shows time. A first plot 301 shows the output voltage over time provided by a voltage regulator, without an auxiliary-current circuit, to a load that cycles. During heavy load cycles, the output voltage dips from about 1.80 volts to about 1.46 volts. A second plot 302 shows the output voltage of the voltage regulator, with the same output capacitor, when equipped with an auxiliary-current circuit. During heavy load cycles, the output voltage drops from about 1.80 volts to about 1.62 volts. Thus, the auxiliary-current circuit can reduce the voltage drop by 0.12 volts using the same size output capacitor. In certain examples, the circuit area occupied by the auxiliary-current circuit is a fraction of the area needed to achieve the same results using a bigger output capacitor. It is understood that the auxiliary-current circuit can be applied to regulators providing a desired output voltage other than 1.80 volts without departing from the scope of the present subject matter. In some examples, the helper transistor is an NPN BJT. In some examples, the helper transistor is an PNP BJT. In some examples, the helper transistor can be a metal-oxide semiconductor (MOS) transistor including but not limited to p-channel or an n-channel MOS transitor.

Various Notes & Examples

In Example 1, a voltage regulator can include an error amplifier configured to compare a first reference voltage with a representation of an output voltage of the voltage regulator, an output transistor coupled to a supply voltage and configured to receive an output of the error amplifier and to provide the output voltage, and an auxiliary-current circuit including a helper transistor having a terminal coupled to the output voltage, the helper transistor having a control node responsive to a second reference voltage, the helper transistor configured to turn on when the output voltage drops due to current demand from the load and to provide charge current to the load in addition to current provided by the output transistor.

In Example 2, the auxiliary-current circuit of Example 1 optionally includes a feedback amplifier having an output coupled to a control node of the helper transistor.

In Example 3, the feedback amplifier of any one or more of Examples 1-2 optionally is configured to hold the control node of the helper transistor at a constant voltage level using the second reference voltage.

In Example 4, the auxiliary-current circuit of any one or more of Examples 1-3 optionally includes a current mirror configured provide a representation of the current provided by the helper transistor to a first input of the feedback amplifier.

In Example 5, the auxiliary-current circuit of any one or more of Examples 1-4 optionally includes a reference generator configured to provide the second reference voltage to a second input of the feedback amplifier.

In Example 6, the reference generator of any one or more of Examples 1-5 optionally includes a current source and a resistor configured to provide the second reference voltage using current supplied by the current source.

In Example 7, the auxiliary-current circuit of any one or more of Examples 1-6 optionally is configured to provide a small current correlated with the current source when the output voltage is free of high frequency disturbances.

In Example 8, an integrated circuit optionally includes the error amplifier, the output transistor, an output capacitor and the auxiliary-current circuit of any one or more of Examples 1-7.

In Example 9, the helper transistor of any one or more of Examples 1-8 optionally includes a bipolar transistor.

In Example 10, the helper transistor of any one or more of Examples 1-9 optionally includes a metal-oxide semiconductor (MOS) transistor.

In Example 11, a method can include comparing a first reference voltage with a representation of an output voltage of a voltage regulator using an error amplifier, receiving an output of the error amplifier at a output transistor coupled to a supply voltage, providing the output voltage using the output transistor, turning on a helper transistor of an auxiliary-current circuit coupled to the output voltage when the output voltage drops due to current demand from the load and to provide charge current to the load in addition to current provided by the output transistor, and limiting current provided by the helper transistor when the output voltage is within a threshold of a desired output voltage using a second reference voltage.

In Example 12, the method of any one or more of Examples 1-11 optionally includes holding a control node of the helper transistor at a constant level using a feedback amplifier of the auxiliary-current circuit.

In Example 13, the method of any one or more of Examples 1-12 optionally includes sensing the charge current provided by the helper transistor using a sense transistor of a current mirror of the auxiliary-current circuit.

In Example 14, the method of any one or more of Examples 1-13 optionally includes providing a mirrored current using a second transistor of the current mirror.

In Example 15, the method of any one or more of Examples 1-14 optionally includes generating a feedback voltage using the mirrored current.

In Examples 16, the method of any one or more of Examples 1-15 optionally includes comparing the feedback voltage to the second reference voltage using a feedback amplifier, providing a helper control signal at an output of the feedback amplifier, the helper control signal based on the comparison of the feedback voltage and the second reference voltage, and receiving the helper control signal at a control node of the helper transistor.

In Example 17, the method of any one or more of Examples 1-16 optionally includes generating the second reference voltage using a reference generator of the auxiliary-current circuit.

In Example 18, the generating the second reference voltage of any one or more of Examples 1-17 optionally includes generating a reference current using a current source of the auxiliary-current circuit, and passing the reference current through a reference resistor, and receiving the second reference voltage generated across the reference resistor at the feedback amplifier.

In Example 19, the method of any one or more of Examples 1-18 optionally includes providing a small current from the auxiliary-current circuit correlated with the current source when the output voltage is free of high frequency transients.

In Example 20, the helper transistor of any one or more of Examples 1-19 optionally includes a bipolar transistor.

In Example 21, the helper transistor of any one or more of Examples 1-20 optionally includes a metal-oxide semiconductor (MOS) transistor.

Example 22 can include, or can optionally be combined with any portion or combination of any portions of any one or more of Examples 1 through 21 to include, subject matter that can include means for performing any one or more of the functions of Examples 1 through 21, or a machine-readable medium including instructions that, when performed by a machine, cause the machine to perform any one or more of the functions of Examples 1 through 21.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A voltage regulator comprising:

an error amplifier configured to compare a first reference voltage with a representation of an output voltage of the voltage regulator;

an output transistor coupled to a supply voltage and configured to receive an output of the error amplifier and to provide the output voltage;

an auxiliary-current circuit including a helper transistor having a terminal coupled to the output voltage, the helper transistor having a control node responsive to a second reference voltage, the helper transistor configured to turn on when the output voltage drops due to current demand from the load and to provide auxiliary current to the load in addition to current provided by the output transistor; and wherein the auxiliary-current circuit includes a feedback amplifier having an output coupled to the control node of the helper transistor.

2. The voltage regulator of claim 1, wherein the feedback amplifier is configured to hold the control node of the helper transistor at a constant voltage level using the second reference voltage.

3. The voltage regulator of claim 2, wherein the auxiliary-current circuit includes a current mirror configured provide a representation of the current provided by the helper transistor to a first input of the feedback amplifier.

4. The voltage regulator of claim 3, wherein the auxiliary-current circuit includes a reference generator configured to provide the second reference voltage to a second input of the feedback amplifier.

5. The voltage regulator of claim 4, wherein the reference generator includes a current source and a resistor configured to provide the second reference voltage using current supplied by the current source.

6. The voltage regulator of claim 1, wherein an integrated circuit includes the error amplifier, the output transistor, an output capacitor and the auxiliary-current circuit.

7. A method comprising:

comparing a first reference voltage with a representation of an output voltage of a voltage regulator using an error amplifier;

receiving an output signal of the error amplifier directly by an output transistor coupled to a supply voltage;

providing the output voltage using the output transistor;

turning on a helper transistor of an auxiliary-current circuit coupled to the output voltage when the output voltage drops due to current demand from the load and to provide auxiliary current to the load in addition to current provided by the output transistor;

limiting current provided by the helper transistor when the output voltage is within a threshold of a desired output voltage using a second reference voltage; and holding a control node of the helper transistor at a constant level using a feedback amplifier of the auxiliary-current circuit.

8. The method of claim 7, including sensing the auxiliary current provided by the helper transistor using a sense transistor of a current mirror of the auxiliary-current circuit.

9. The method of claim 8, including providing a mirrored current using a second transistor of the current mirror.

10. The method of claim 9; including generating a feedback voltage using the mirrored current.

11. The method of claim 10, including comparing the feedback voltage to the second reference voltage using a feedback amplifier;

providing a helper control signal at an output of the feedback amplifier, the helper control signal based on the comparison of the feedback voltage and the second reference voltage; and receiving the helper control signal at a control node of the helper transistor.

12. The method of claim 11; including generating the second reference voltage using a reference generator of the auxiliary-current circuit.

13. The method of claim 11, wherein the generating the second reference voltage includes generating a reference current using a current source of the auxiliary-current circuit, and passing the reference current through a reference resistor; and receiving the second reference voltage generated across the reference resistor at the feedback amplifier.

14. The method of claim 7, including providing a small current from the auxiliary-current circuit correlated with the current source when the output voltage does not substantially include high frequency transients.

15. The method of claim 7, wherein the helper transistor includes a bipolar transistor.

16. The method of claim 7, wherein the helper transistor includes a metal-oxide semiconductor (MOS) transistor.

17. A low-dropout regulator configured to couple to a load, the low-drop-out regulator comprising:

an error amplifier configured to provide an output voltage error signal;

an output transistor coupled between a supply node and the load, the output transistor configured to receive the output voltage error signal directly from the error amplifier, and to provide first output current at an output voltage based on the output voltage error signal; and auxiliary current circuit for providing auxiliary output current in addition to the output current, the auxiliary current circuit responsive to a drop in the output voltage due to current demand from the load, wherein the auxiliary current circuit includes a helper transistor having a terminal coupled directly to the output voltage, the helper transistor having a control node responsive to a second reference voltage, the helper transistor configured to turn on when the output voltage drops due to current demand from the load and to provide auxiliary current to the load, via the terminal, in addition to the first output current provided by the output transistor, wherein the output of the error amplifier is directly coupled to a control node of the output transistor.

* * * * *